US009586413B2

(12) United States Patent
Saitoh

(10) Patent No.: US 9,586,413 B2
(45) Date of Patent: Mar. 7, 2017

(54) TREATMENT-OBJECT MODIFYING DEVICE, PRINTING APPARATUS, PRINTING SYSTEM, AND METHOD OF MANUFACTURING PRINT

(71) Applicant: Haruki Saitoh, Kanagawa (JP)

(72) Inventor: Haruki Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/536,302

(22) Filed: Nov. 7, 2014

(65) Prior Publication Data

US 2015/0138287 A1 May 21, 2015

(30) Foreign Application Priority Data

Nov. 15, 2013 (JP) ..... 2013-237214
Aug. 27, 2014 (JP) ..... 2014-173055

(51) Int. Cl.
*B41J 2/01* (2006.01)
*B41J 11/00* (2006.01)
*H05H 1/24* (2006.01)

(52) U.S. Cl.
CPC .. *B41J 11/0015* (2013.01); *H05H 2001/2412* (2013.01); *H05H 2001/2431* (2013.01)

(58) Field of Classification Search
None
See application file for complete search history.

(56) References Cited

U.S. PATENT DOCUMENTS

2009/0290007 A1 11/2009 Saitoh et al.
2012/0141181 A1* 6/2012 Bisaiji ..... G03G 15/168 399/390
2013/0250017 A1* 9/2013 Saitoh ..... C08J 7/00 347/101

(Continued)

FOREIGN PATENT DOCUMENTS

EP 1029702 B1 4/2004
EP 1464491 A2 10/2004

(Continued)

OTHER PUBLICATIONS

Machine generated English translation of JP 2004-311116A to Sawada Koji, "Plasma Processing Method and Plasma Processing Device", Nov. 4, 2004, Japan Patent Office, pp. 1-14.*

(Continued)

*Primary Examiner* — Matthew Luu
*Assistant Examiner* — Tracey McMillion
(74) *Attorney, Agent, or Firm* — Duft Bornsen & Fettig LLP

(57) ABSTRACT

A treatment-object modifying device lowers a pH value of a surface of a treatment object by using dielectric-barrier discharge. The treatment-object modifying device includes discharge electrodes disposed over a conveying route of the treatment object; and a counter electrode disposed to face the discharge electrodes across the conveying route so as to correspond to the respective discharge electrodes. Each discharge electrode has a columnar shape or a cylindrical shape. Curved surfaces of the discharge electrodes faces the counter electrode. Curved surfaces of the discharge electrodes face one another. A distance between the adjacent discharge electrodes is equal to or less than 2 millimeters.

8 Claims, 9 Drawing Sheets

(56) References Cited

U.S. PATENT DOCUMENTS

2014/0265911 A1* 9/2014 Kamata ..... H02M 1/08
315/277

FOREIGN PATENT DOCUMENTS

| | | | | |
|---|---|---|---|---|
| JP | 2002-058995 | | | 2/2002 |
| JP | 2004-311116 | | | 11/2004 |
| JP | 2004311116 | A | * | 11/2004 |
| JP | 3960190 | | | 5/2007 |
| JP | 2008296526 | A | | 12/2008 |
| JP | 4414765 | | | 11/2009 |
| JP | 2010-097935 | | | 4/2010 |
| JP | 2012-123062 | | | 6/2012 |
| JP | 2013-095562 | | | 5/2013 |
| WO | WO03/071839 | | | 8/2003 |
| WO | 2011095930 | A1 | | 8/2011 |

OTHER PUBLICATIONS

Machine generated English translation of JP 2004-3111116A to Sawada Koji, "Plasma Processing Method and Plasma Processing Device", Nov. 4, 2004, Japan Patent Office, pp. 1-14.*

Machine generated English translation of JP 2004-31111116A to Sawada Koji. "Plasma Proceesing Method and Plasma Processing Device", Nov. 4, 2004, Japan Patent Office, pp. 1-14.*

* cited by examiner

TREATMENT-OBJECT MODIFYING DEVICE, PRINTING APPARATUS, PRINTING SYSTEM, AND METHOD OF MANUFACTURING PRINT

CROSS-REFERENCE TO RELATED APPLICATIONS

The present application claims priority to and incorporates by reference the entire contents of Japanese Patent Application No. 2013-237214 filed in Japan on Nov. 15, 2013 and Japanese Patent Application No. 2014-173055 filed in Japan on Aug. 27, 2014.

BACKGROUND OF THE INVENTION

1. Field of the Invention

The present invention relates to a treatment-object modifying device, a printing apparatus, a printing system, and a method of manufacturing a print.

2. Description of the Related Art

In conventional inkjet recording devices, because a shuttle system in which a head shuttles in a width direction of a recording medium that is typified by paper and film is dominant, it has been difficult to improve throughput by high-speed printing. Consequently, in recent years, to deal with the high-speed printing, developed has been a single-pass system that records at one time by arranging a plurality of heads such that the whole width of the recording medium is covered.

The single-pass system is advantageous for speed-up. However, because the time interval to eject an adjacent dot is short and the adjacent dot is ejected before the ink previously ejected permeates the recording medium, there have been problems such as beading and bleeding in which the coalescence of adjacent dots (hereinafter, referred to as ejected droplet interference) occurs, whereby the image quality is deteriorated. There have been situations in which such problems are particularly noticeable when printing is made on non-permeable media and slow-permeable media such as film and coated paper.

As for the technologies to solve such problems, already known have been a countermeasure method of applying a pre-coating agent on a medium in advance so as to enhance the cohesiveness and fixity (also referred to as setting property) of ink, and a method that uses UV-curable ink. In the method that uses the pre-coating agent, however, the water of the pre-coating agent, other than the water of the ink, needs to be evaporated and dried, and thus it necessitates a longer drying time and a larger drying device. Furthermore, in the method that uses a pre-coating agent of a supply article or that uses relatively expensive UV-curable ink, there has been a problem in that the printing cost is increased.

Thus, in recent years, as another method to enhance the setting property of ink, a method of performing plasma treatment on a media surface has been developed. It is known that, when plasma treatment is performed on a media surface, the media surface has hydrophilicity. Performing such plasma treatment on a medium as pretreatment can improve the hydrophilicity and wettability thereof even when a medium such as coated paper which has poor wettability is used, for example, and as a result, a print of higher image quality can be manufactured. Furthermore, because the plasma treatment is a dry process, a drying process is not necessary, and thus there is an advantage in that the modification treatment can be performed on the surface of a treatment object more efficiently. Related-art examples are described in Japanese Patent No. 4414765 and Japanese Patent Application Laid-open No. 2002-058995.

In the foregoing method that applies a pre-coating agent on a printing medium in advance, however, the water of the pre-coating agent, other than the water of the ink, needs to be evaporated and dried, and thus it necessitates a longer drying time and a larger drying device. Furthermore, in the method that uses a pre-coating agent of a supply article or that uses relatively expensive UV-curable ink, there has been a problem in that the printing cost is increased.

Therefore, there is a need to provide a treatment-object modifying device, a printing apparatus, a printing system, and a method of manufacturing a print that can manufacture a print of high image quality while reducing an increase in cost.

SUMMARY OF THE INVENTION

It is an object of the present invention to at least partially solve the problems in the conventional technology.

According to an embodiment, there is provided a treatment-object modifying device that lowers a pH value of a surface of a treatment object by using dielectric-barrier discharge. The treatment-object modifying device includes a plurality of discharge electrodes disposed over a conveying route of the treatment object; and one or more counter electrodes disposed to face the discharge electrodes across the conveying route so that the one or more counter electrodes is in common with the discharge electrodes or correspond to the respective discharge electrodes. Each of the discharge electrodes has a columnar shape or a cylindrical shape. Curved surfaces of the discharge electrodes faces the one or more counter electrodes. Curved surfaces of the discharge electrodes face one another. A distance between the adjacent discharge electrodes is equal to or less than 2 millimeters.

According to another embodiment, there is provided a printing apparatus that includes the treatment-object modifying device according to the above embodiment; and a recording unit that performs inkjet recording on the surface of the treatment object on which modification treatment has been performed by the treatment-object modifying device.

According to still another embodiment, there is provided a printing system that includes the treatment-object modifying device according to the above embodiment; and a recording device that performs inkjet recording on the surface of the treatment object on which modification treatment has been performed by the treatment-object modifying device.

According to still another embodiment, there is provided a method of manufacturing a print using a treatment-object modifying device that includes a plurality of discharge electrodes disposed over a conveying route of a treatment object and one or more counter electrodes disposed to face the discharge electrodes across the conveying route so that the one or more counter electrodes is in common with the discharge electrodes or correspond to the respective discharge electrodes, the treatment-object modifying device lowering a pH value of a surface of the treatment object by using dielectric-barrier discharge, and also using a recording device that performs inkjet recording on the surface of the treatment object on which modification treatment has been performed by the treatment-object modifying device. The method includes conveying the treatment object along the conveying route; applying a discharge voltage between the discharge electrodes and the one or more counter electrodes;

and performing inkjet recording on the surface of the treatment object on which the modification treatment has been performed at the applying. Each of the discharge electrodes has a columnar shape or a cylindrical shape. Curved surfaces of the discharge electrodes faces the one or more counter electrodes. Curved surfaces of the discharge electrodes face one another. A distance between the adjacent discharge electrodes is equal to or less than 2 millimeters.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
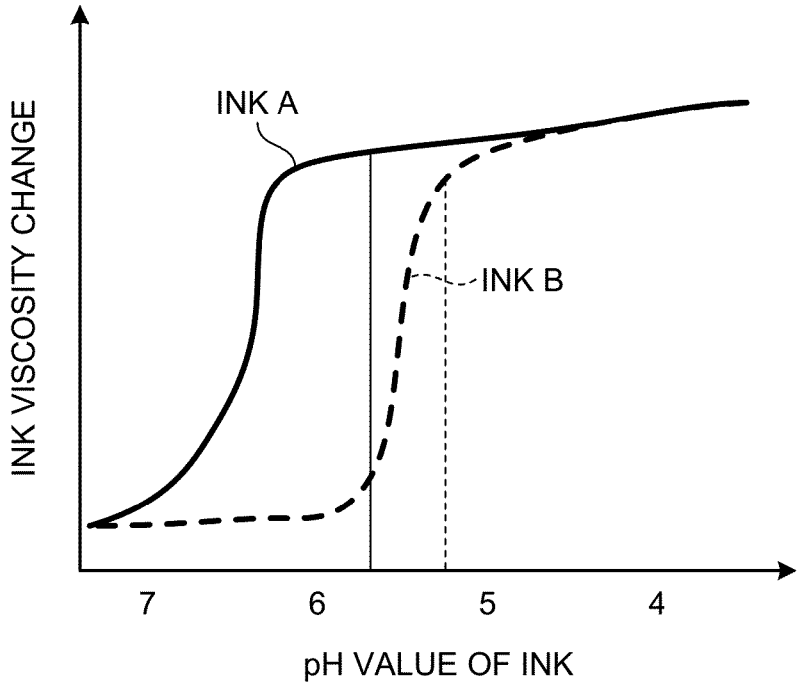
FIG. 1 is a chart illustrating an example of the relation between the pH value of ink and the viscosity thereof according to an embodiment of the present invention.

The following describes in detail a preferred embodiment of the present invention based on the accompanying drawings. Note that the following exemplary embodiment is a preferred embodiment of the invention and thus has various technically preferable limitations. However, the scope of the invention is not maliciously limited by the following description, and furthermore, not all of the configurations described in the embodiment are essential constituent elements of the invention.

In the following embodiment, to make ink pigments flocculate immediately after the ink lands on a treatment object (also referred to as a recording medium or a printing medium) while preventing the pigments from dispersing, the surface of the treatment object is acidified. As a means to acidify, plasma treatment is exemplified.

Furthermore, in the following embodiment, by controlling the wettability of a plasma-treated surface of the treatment object and controlling the cohesiveness and permeability of ink pigments by lowering a pH value, the roundness of ink dots (hereinafter, simply referred to as dots) is improved and the coalescence of the dots is prevented, whereby the sharpness of the dots is improved and the color gamut thereof is extended. Consequently, defects of an image such as beading and bleeding can be solved, and a print on which a high quality image is formed can be obtained. Furthermore, by making the thickness of the flocculation of pigments on the treatment object thin and uniform, the amount of ink droplets can be reduced, whereby the reduction in energy for drying ink and the reduction in printing cost can be achieved.

In the plasma treatment as an acidification processing means (step), a treatment object is irradiated with plasma in the atmosphere, whereby the macromolecules of the surface of the treatment object are made to react and hydrophilic functional groups are formed. In detail, electrons e emitted from a discharge electrode are accelerated in an electric field, and the electrons excite and ionize the atoms and molecules in the atmosphere. The electrons are also emitted from the ionized atoms and molecules, whereby high-energy electrons are increased, and as a result, streamer discharge (plasma) occurs. By the high-energy electrons of the streamer discharge, the polymeric binding of the surface of the treatment object (for example, coated paper) is cut off (the coat layer of the coated paper is solidified with calcium carbonate and starch as a binder, and the starch has a polymeric molecular structure) and recombination occurs with oxygen radicals O*, hydroxyl radicals (—OH), and ozone $O_3$ in a gas phase. The foregoing processes are referred to as plasma treatment. Consequently, on the surface of the treatment object, polar functional groups such as hydroxyl groups and carboxyl groups are formed. As a result, the surface of a printing medium is given the hydrophilicity and acidity. Note that the surface of the printing medium is acidified (the lowering of pH value) due to the increase in carboxyl groups.

It has also been found that, to prevent the occurrence of color mixture between dots as the adjacent dots on the treatment object get wet, spread, and coalesce due to the improvement in hydrophilicity, it is important to make colorant (for example, pigments and dyes) flocculate within a dot and to make vehicles dry or permeate quicker than the vehicles get wet and spread. Consequently, in the embodiment, acidification treatment in which the surface of the treatment object is acidified is performed as pretreatment of an inkjet recording process.

The acidification in the present explanation means to lower the pH value of the surface of a printing medium to a pH value at which the pigments included in ink flocculate. To lower the pH value means to increase the concentration of hydrogen ions $H^+$ in an object. The pigments in ink before contacting the surface of the treatment object are charged in negative and are dispersed within vehicles. FIG. 1 illustrates an example of the relation between the pH value of ink and the viscosity thereof. As illustrated in FIG. 1, as the pH value of the ink lowers, the viscosity thereof increases. This is because, as the acidity of the ink increases, the pigments that are charged in negative in the vehicles of the ink are further neutralized electrically, and as a result, the pigments flocculate. Consequently, in the chart illustrated in FIG. 1, for example, by lowering the pH value of the surface of a recording medium such that the pH value of the ink becomes a value corresponding to the necessary viscosity, it is possible to increase the viscosity of the ink. This is because the pigments flocculate as a result of the pigments being electrically neutralized by the hydrogen ions $H^+$ on the surface of the printing medium when the ink adheres to the surface of the printing medium that is acidic. Thus, it is possible to prevent the colors from being mixed between adjacent dots and to prevent the pigments from permeating deep inside the printing medium (or further to the rear surface). To lower the pH value of the ink to be the pH value corresponding to the necessary viscosity, however, it is necessary to make the pH value of the surface of the printing medium lower than the pH value of the ink corresponding to the necessary viscosity.

Furthermore, the pH value to make the ink to be of necessary viscosity differs depending on the characteristics of the ink. That is, as ink A illustrated in FIG. 1, there is ink that increases the viscosity as the pigments flocculate at a pH value relatively close to neutral, and as illustrated as ink B that has different characteristics from that of the ink A, there is ink that needs a lower pH value than that of the ink A to make the pigments flocculate.

The behavior of colorant to flocculate within dots, the drying rate of vehicles, and the permeation rate of the vehicles into the treatment object differ by the amount of droplets that varies by the size of dots (small droplets, medium droplets, large droplets), the type of treatment object, and others. Consequently, in the following embodiment, the amount of plasma energy in plasma treatment may be controlled to an optimum value in response to the type of treatment object, a printing mode (the amount of droplets), and others.

Figure 2:
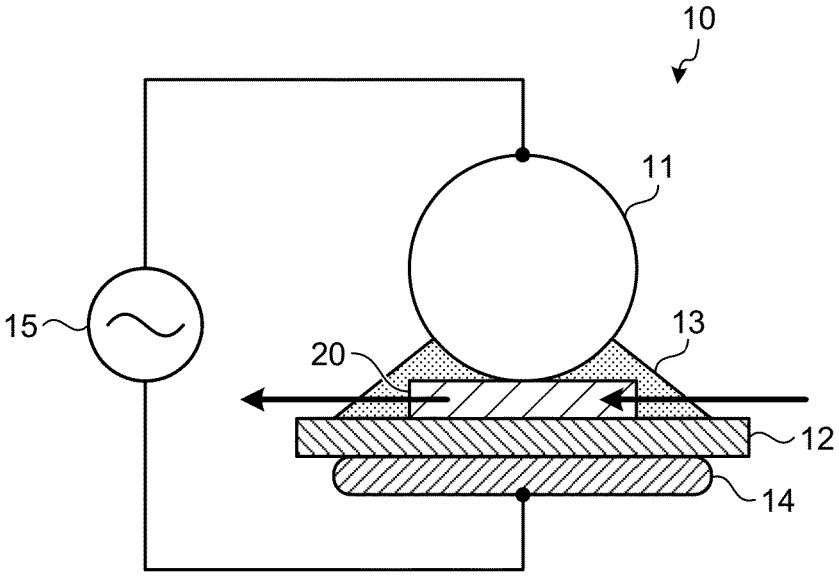
FIG. 2 is a schematic diagram illustrating an example of a plasma treatment device in the embodiment.

FIG. 2 is a schematic diagram for explaining the outline of the acidification treatment employed in the embodiment. As illustrated in FIG. 2, in the acidification treatment employed in the embodiment, used is a plasma treatment device 10 that includes a discharge electrode 11, a counter electrode 14, a dielectric 12, and a high-frequency high-voltage power supply 15. In the plasma treatment device 10, the dielectric 12 is disposed between the discharge electrode 11 and the counter electrode 14. The discharge electrode 11 and the counter electrode 14 may be the electrodes the metallic portion of which is exposed or may be the electrodes that are covered with dielectric or insulating material such as insulating rubber and ceramic. The dielectric 12 disposed between the discharge electrode 11 and the counter electrode 14 may be insulating material such as polyimide, silicon, and ceramic. Note that, when corona discharge is employed as the plasma treatment, the dielectric 12 may be omitted. However, there may be cases in which providing the dielectric 12 is preferable, for example, when dielectric-barrier discharge is employed. In that case, if the dielectric 12 is positioned closer toward or in contact with the counter electrode 14 rather than positioned closer toward or in contact with the discharge electrode 11, the area of creeping discharge expands, and thus the effect of plasma treatment can be further enhanced. Moreover, the discharge electrode 11 and the counter electrode 14 (or the dielectric 12 on the side of the electrode on which the dielectric 12 is provided) may be disposed at a position in which a treatment object 20 that runs through between the two electrodes contacts, or may be disposed at a position in which the treatment object 20 does not contact.

The high-frequency high-voltage power supply 15 applies a high-frequency high-voltage repetitive pulse voltage between the discharge electrode 11 and the counter electrode 14. The value of the repetitive pulse voltage is approximately 10 kV (kilovolts) p-p, for example. The frequency thereof can be approximately 20 kHz (kilohertz), for example. Supplying such a high-frequency high-voltage repetitive pulse voltage between the two electrodes generates atmospheric non-equilibrium plasma 13 between the discharge electrode 11 and the dielectric 12. The treatment object 20 runs through between the discharge electrode 11 and the dielectric 12 while the atmospheric non-equilibrium plasma 13 is generated. Consequently, the plasma treatment is performed on the surface of the treatment object 20 on the discharge electrode 11 side.

The plasma treatment device 10 illustrated in FIG. 2 employs the discharge electrode 11 of a rotary type and the dielectric 12 of a belt conveyer type. The treatment object 20 runs through the atmospheric non-equilibrium plasma 13 by being clamped and conveyed between the rotating discharge electrode 11 and the dielectric 12. Consequently, the surface of the treatment object 20 is brought into contact with the atmospheric non-equilibrium plasma 13, and the plasma treatment is uniformly performed thereon. The plasma treatment device employed in the embodiment, however, is not limited to the configuration illustrated in FIG. 2. For example, various modifications can be made such as the configuration in which the discharge electrode 11 is not in contact with but close to the treatment object 20, and the configuration in which the discharge electrode 11 is mounted on the same carriage as that for an inkjet head. Furthermore, it is not limited to the dielectric 12 of a belt conveyer type, and it is also possible to employ the dielectric 12 of a flat plate type.

Figure 3:
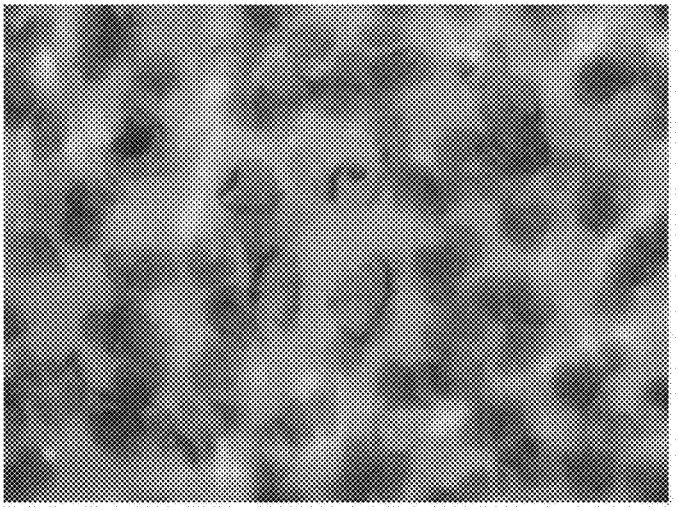
FIG. 3 is an enlarged view of an image acquired by capturing an image of an image forming surface of a print obtained by performing an inkjet recording process on a treatment object on which plasma treatment in the embodiment was not performed.
Figure 4:
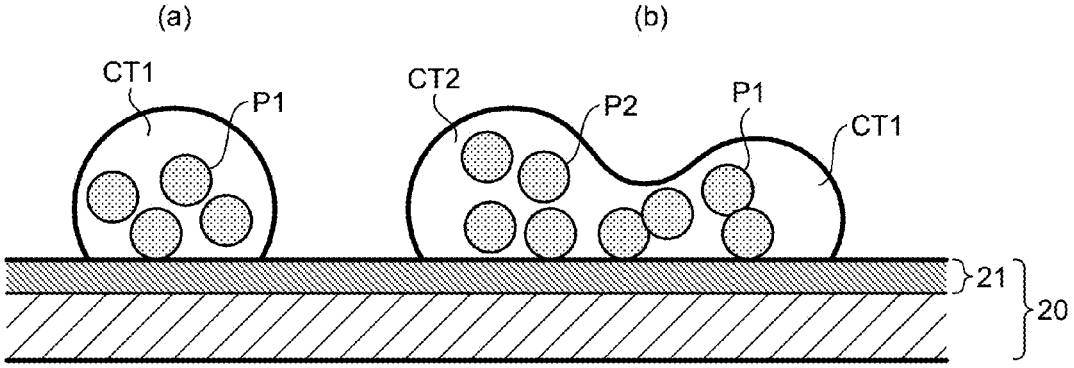
FIG. 4 is a schematic diagram illustrating an example of dots formed on the image forming surface of the print illustrated in FIG. 3.
Figure 5:
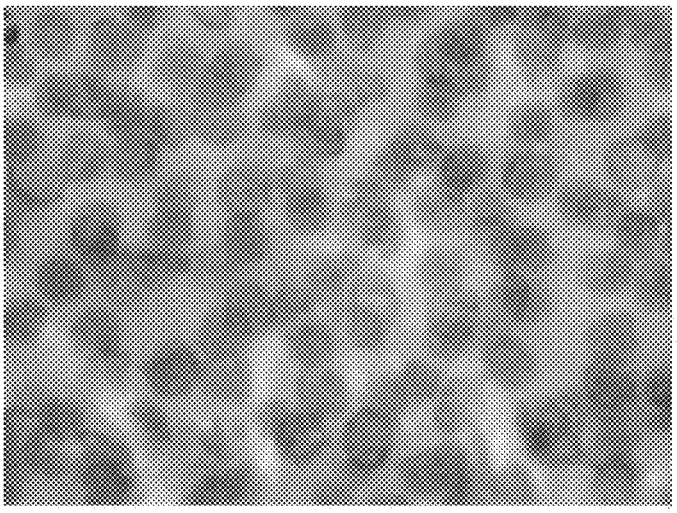
FIG. 5 is an enlarged view of an image acquired by capturing an image of an image forming surface of a print obtained by performing an inkjet recording process on a treatment object on which the plasma treatment in the embodiment has been performed.
Figure 6:
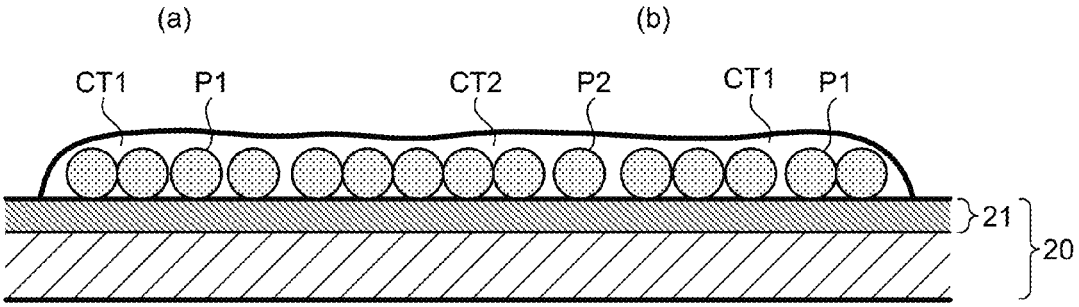
FIG. 6 is a schematic diagram illustrating an example of dots formed on the image forming surface of the print illustrated in FIG. 5.

Now, with reference to FIGS. 3 to 6, the following describes the difference in prints between when the plasma treatment in the embodiment is performed and when not performed. FIG. 3 is an enlarged view of an image acquired by capturing an image of an image forming surface of a print obtained by performing an inkjet recording process on a treatment object on which the plasma treatment in the embodiment was not performed, and FIG. 4 is a schematic diagram illustrating an example of dots formed on the image forming surface of the print illustrated in FIG. 3. FIG. 5 is an enlarged view of an image acquired by capturing an image of an image forming surface of a print obtained by performing an inkjet recording process on a treatment object on which the plasma treatment in the embodiment has been performed, and FIG. 6 is a schematic diagram illustrating an example of dots formed on the image forming surface of the print illustrated in FIG. 5. To obtain the prints illustrated in FIGS. 3 and 5, a desktop inkjet recording device was used. As for the treatment object 20, ordinary coated paper that includes a coat layer 21 was used.

In the coated paper on which the plasma treatment in the embodiment is not performed, the coat layer present on the surface of the coated paper is poor in wettability. Consequently, in the image formed in the inkjet recording process on the coated paper on which the plasma treatment is not performed, as illustrated in FIGS. 3 and 4, the shape of the dots (shape of vehicles CT1) that adhere to the surface of the coated paper is distorted when the dots landed. Furthermore, when adjacent dots are formed while the drying of the dots is not sufficient, as illustrated in FIGS. 3 and 4, the vehicle CT1 and a vehicle CT2 coalesce with each other at the time the adjacent dots landed, and thus the transfer of pigments P1 and P2 (color mixture) occurs, and as a result, the unevenness in density by beading and the like may be produced.

Meanwhile, in the coated paper on which the plasma treatment in the embodiment has been performed, the wettability of the coat layer present on the surface of the coated paper was improved. Consequently, in the image formed in the inkjet recording process on the coated paper on which the plasma treatment has been performed, as illustrated in FIG. 5, the vehicles CT1 spread into a relatively flat perfect circle form on the surface of the coated paper. Thus, as illustrated in FIG. 6, the dots are in a flat shape. Furthermore, because the surface of the coated paper is acidified by the polar functional groups that are formed in the plasma treatment, the ink pigments are electrically neutralized and the pigments P1 flocculate, and thus the viscosity of the ink increases. Consequently, as illustrated in FIG. 6, even when the vehicles CT1 and CT2 coalesce with each other, the transfer of the pigments P1 and P2 (color mixture) between dots is suppressed. Furthermore, because the polar functional groups are also formed inside the coat layer 21, the permeability of the vehicles CT1 is increased, and that enables the paper to be dried in a relatively short period of time. The dots that spread in a perfect circle form due to the improvement in wettability permeate while flocculating, and thus the pigments P1 can uniformly flocculate in the height direction, whereby the occurrence of unevenness in density by beading and the like can be prevented. Note that FIGS. 4 and 6 are schematic diagrams, and in reality, the pigments flocculate in layers even in the situation in FIG. 6.

As in the foregoing, in the treatment object 20 on which the plasma treatment in the embodiment has been performed, the hydrophilic functional groups are produced on the surface of the treatment object 20 by the plasma treatment and the wettability thereof is improved. Furthermore, as a result of the functional groups being formed by the plasma treatment, the surface of the treatment object 20 becomes acidic. Consequently, the landed ink spreads uniformly on the surface of the treatment object 20 while the pigments charged in negative are neutralized on the surface of the treatment object 20. This makes the pigments flocculate and increases the viscosity of the ink, and even when the dots coalesce as a result, the transfer of the pigments can be suppressed. Furthermore, by the polar functional groups being also produced inside the coat layer 21 formed on the surface of the treatment object 20, the vehicles permeate rapidly inside the treatment object 20, and this enables the drying time to be shortened. That is, the dots that spread in a perfect circle form due to the increased wettability permeate in a state of the transfer of pigments being suppressed by the flocculation can keep the shape close to a perfect circle.

Figure 7:
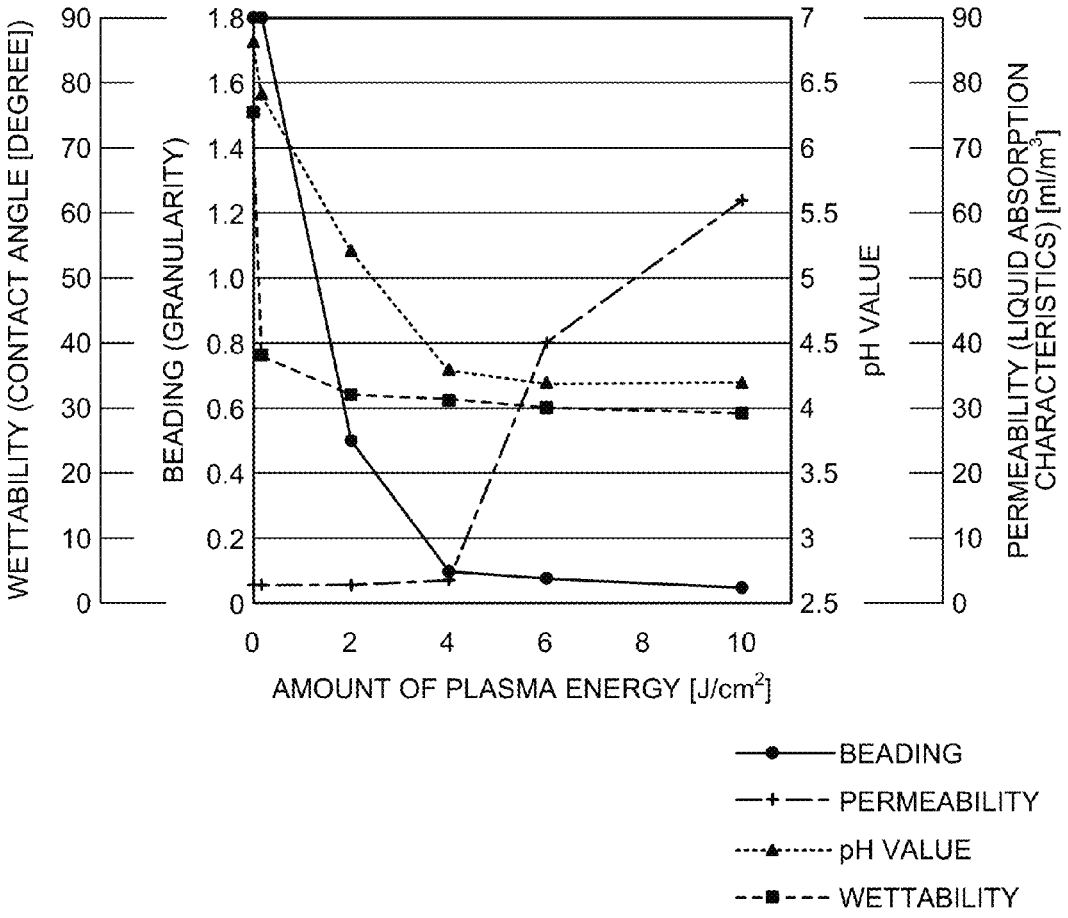
FIG. 7 is a chart illustrating the relation between the amount of plasma energy and the wettability, beading, pH value, and permeability of the surface of a treatment object in the embodiment.

FIG. 7 is a chart illustrating the relation between the amount of plasma energy and the wettability, beading, pH value, and permeability of the surface of the treatment object in the embodiment. FIG. 7 illustrates how the surface characteristics (wettability, beading, pH value, and permeability (liquid absorption characteristics)) vary depending on the amount of plasma energy when coated paper as the treatment object 20 is printed. To acquire the evaluation illustrated in FIG. 7, used for ink was an aqueous pigment ink having the characteristics in which pigments flocculate by acid (an alkaline ink in which the pigments charged in negative are dispersed).

As illustrated in FIG. 7, the wettability of the surface of the coated paper is drastically improved at a low value in the amount of plasma energy (for example, approximately 0.2 $J/cm^2$ or less), and is not much improved even when the energy is increased higher than that. Meanwhile, the pH value of the surface of the coated paper lowers to a certain extent as the amount of plasma energy is increased. However, when the amount of plasma energy exceeds a certain value (for example, approximately 4 $J/cm^2$), it reaches a saturated state. Furthermore, the permeability (liquid absorption characteristics) is drastically improved in the region in which the lowering of the pH value is saturated (for example, approximately 4 $J/cm^2$). This phenomenon, however, varies depending on the polymer components included in the ink.

As a result of this, the value of beading (granularity) is in a very good state after the permeability (liquid absorption characteristics) begins to improve (for example, approximately 4 $J/cm^2$). The beading (granularity) here is the roughness of an image expressed in numerical terms, and is the fluctuation in density expressed by the standard deviation of average density. In FIG. 7, a plurality of samples of the density of a solid color image that is composed of dots in two or more colors are obtained, and the standard deviation of the density thereof is represented as the beading (granularity). Consequently, the ink discharged on the coated paper on which the plasma treatment in the embodiment has been performed spreads in a perfect circle form and permeates while flocculating, and thus the beading (granularity) of the image is improved.

As in the foregoing, in the relation between the characteristics of the surface of the treatment object 20 and the image quality, due to the wettability of the surface being improved, the roundness of dots is improved. It can be considered that the reason for this is that, due to the increase in surface roughness and the hydrophilic polar functional groups produced by the plasma treatment, the wettability of the surface of the treatment object 20 is improved and homogenized. Furthermore, it can also be considered that, as one of the factors, the water repelling elements such as dust, oil, and calcium carbonate are removed by the plasma treatment. More specifically, it can be considered that, as a result of the wettability of the surface of the treatment object 20 being improved while the destabilizing factors on the surface of the treatment object 20 are removed, the droplets spread evenly in the circumferential direction and the roundness of the dots is improved.

Furthermore, acidifying (the lowering of pH value) the surface of the treatment object 20 produces, for example, the flocculation of ink pigments, the improvement in permeability, and the permeation of vehicles to the inside of the coat layer. Consequently, because the pigment concentration on the surface of the treatment object 20 is increased, even if the coalescence of dots occurs, it is possible to suppress the transfer of pigments, and as a result, the turbidity of pigments is suppressed and the pigments can be made to precipitate and flocculate evenly on the surface of the treatment object 20. The effect of suppressing the turbidity of pigments, however, varies depending on the components of ink and the amount of ink drop. For example, when the amount of ink drop is a small droplet, as compared with a large droplet, the turbidity of pigments by the coalescence of dots is hard to occur. This is because, when the amount of vehicles is a small droplet, the vehicles dry and permeate faster and the pigments can flocculate with small pH reaction. Note that the effect of the plasma treatment varies depending on the type and the environment (humidity and others) of the treatment object 20. Consequently, the amount of plasma energy in the plasma treatment may be controlled to an optimum value in response to the amount of droplet and the type, environment, and others of the treatment object 20. As a result, there may be a situation in which the modification efficiency of the surface of the treatment object 20 is improved and further energy-saving can be achieved.

Figure 8:
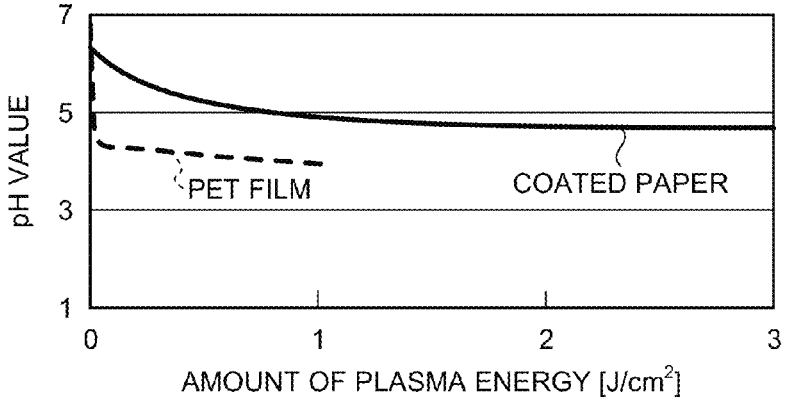
FIG. 8 is a chart illustrating an example of the relation between the amount of plasma energy and the pH value of the surface of a treatment object for each medium.

FIG. 8 is a chart illustrating the relation between the amount of plasma energy and the pH value in the embodiment. While it is common that the pH value is usually measured in solution, in recent years, it has been possible to measure the pH value of the surface of a solid. As the measuring instrument, available is the pH meter B-211 manufactured by HORIBA Ltd., for example.

In FIG. 8, the solid line represents the dependency on plasma energy of the pH value of a coated paper, and the dotted line represents the dependency on plasma energy of the pH value of a PET film. As illustrated in FIG. 8, as compared with the coated paper, the PET film is acidified with small plasma energy. However, even with the coated paper, the amount of plasma energy at the time of acidification was approximately 3 $J/cm^2$ or less. Then, on the treatment object 20 the pH value of which became 5 or less, when image recording was made with an inkjet processing device that discharges an alkaline aqueous pigment ink, the dots of the formed image were in a shape close to a perfect circle. Furthermore, the turbidity of pigments by the coalescence of dots was not found, and a good image without bleeding was obtained (see FIG. 5).

Next, a treatment-object modifying device, a printing apparatus, a printing system, and a method of manufacturing a print in the embodiment will be described in detail with reference to the drawings.

While an image forming apparatus that has discharge heads (print heads, ink heads) for four colors of black (K), cyan (C), magenta (M), and yellow (Y) in the embodiment, it is not limited to these discharge heads. More specifically, the apparatus may further have discharge heads that correspond to the colors of green (G), red (R), and other colors, or may have only the discharge head of black (K). In the following description, the letters K, C, M, and Y correspond to black, cyan, magenta, and yellow, respectively.

While continuous paper that is wound in a roll (hereinafter, referred to as roll paper) is used as a treatment object in the embodiment, it is not limited to this, and it only needs to be a recording medium such as cut paper on which an image can be formed, for example. If it is paper, the type of paper that can be used includes plain paper, high-quality paper, recycled paper, thin paper, heavy paper, and coated paper, for example. Furthermore, OHP transparencies, synthetic resin films, metal thin films, and others on the surface of which an image can be formed with ink can also be used as the treatment object. When the paper is non-permeable or slow-permeable paper such as coated paper, the invention is more effective. The roll paper may be continuous paper (continuous form paper, continuous business form) on which cuttable perforations are formed at a given interval. In that case, a page in roll paper is defined as an area sandwiched by the perforations in a given interval, for example.

Figure 9:
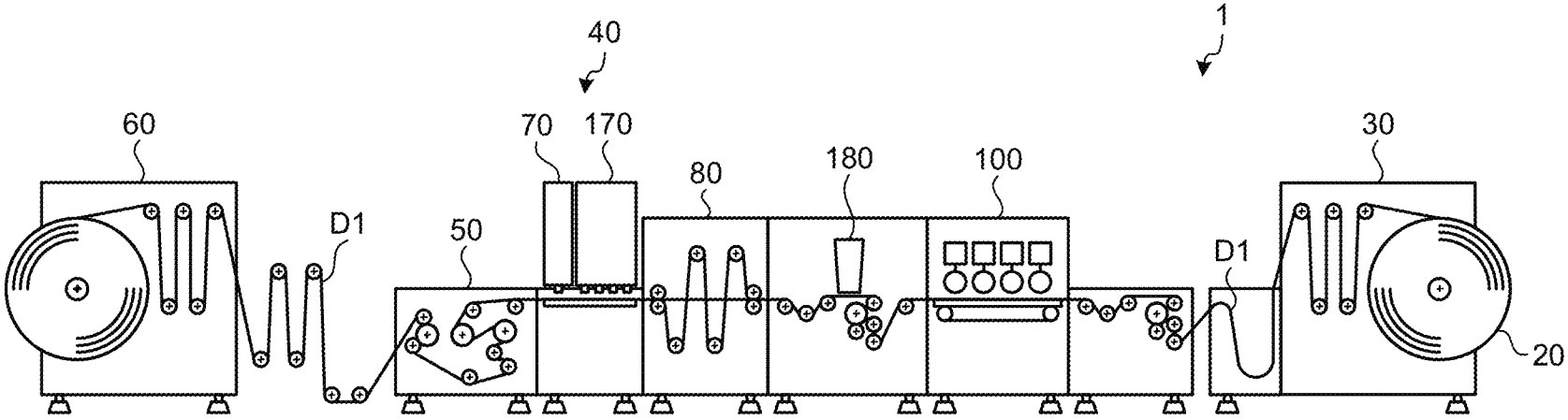
FIG. 9 is a schematic diagram illustrating the configuration of a printing apparatus (system) in the embodiment.

FIG. 9 is a diagram schematically illustrating the configuration of the printing apparatus (system) in the embodiment. As illustrated in FIG. 9, a printing apparatus (system) 1 includes a carry-in unit 30 that carries in (conveys) the treatment object 20 (roll paper) along a conveying route D1, a plasma treatment device 100 that performs plasma treatment on the carried-in treatment object 20 as pretreatment, and an image forming apparatus 40 that forms an image on the surface of the plasma-treated treatment object 20. The foregoing devices may be present in separate housings to constitute a system as a whole, or may be housed as a printing apparatus in the same housing. Furthermore, when they are configured as the printing system, a controller that controls the whole or a part of the system may be included in any of the devices or may be provided in a separate independent housing.

Between the plasma treatment device 100 and an inkjet recording device 170, provided is a buffer unit 80 to adjust the feed rate of the treatment object 20, on which the pretreatment such as plasma treatment has been performed, to the inkjet recording device 170. The image forming apparatus 40 further includes the inkjet recording device 170 that forms an image on the plasma-treated treatment object 20 by inkjet processing. The image forming apparatus 40 may further include a post-processing unit 70 that performs post-processing on the image-formed treatment object 20.

The printing apparatus (system) 1 may include a drying unit 50 that dries the post-processed treatment object 20 and a discharge unit 60 that discharges the image-formed (post-processed further in some cases) treatment object 20. The printing apparatus (system) 1 may further include, besides the plasma treatment device 100, a pre-coating processing unit (not depicted) that applies treatment liquid referred to as a pre-coating agent that includes macromolecular material on the surface of the treatment object 20 as a pretreatment processing unit that performs pretreatment on the treatment object 20. Furthermore, between the plasma treatment device 100 and the image forming apparatus 40, provided may be a pH detector 180 to detect the pH value of the surface of the treatment object 20 after the pretreatment by the plasma treatment device 100.

Moreover, the printing apparatus (system) 1 includes a controller (not depicted) that controls the operation of the various units. The controller may be connected to a print control device that generates raster data from image data of a print object, for example. The print control device may be provided inside the printing apparatus (system) 1 or may be provided outside via a network such as the Internet and a local area network (LAN).

In the embodiment, in the printing apparatus (system) 1 illustrated in FIG. 9, as in the foregoing, the acidification treatment in which the surface of the treatment object is acidified is performed prior to the inkjet recording process. For this acidification treatment, atmospheric non-equilibrium plasma treatment that uses dielectric-barrier discharge can be employed, for example. The acidification treatment by atmospheric non-equilibrium plasma is one of the preferred methods for a treatment object such as a recording medium because the electron temperature is extremely high and the gas temperature is close to normal temperature.

To stably generate atmospheric non-equilibrium plasma in a broad range, preferably performed is the atmospheric non-equilibrium plasma treatment that employs dielectric-barrier discharge of a streamer breakdown form. The dielectric-barrier discharge of a streamer breakdown form can be achieved by applying an alternating high voltage between dielectric covered electrodes, for example.

As for the method to generate the atmospheric non-equilibrium plasma, a variety of methods can be used, other than the above-described dielectric-barrier discharge of a streamer breakdown form. For example, dielectric-barrier discharge that uses an insulator of dielectric or the like inserted between electrodes, corona discharge that forms an extremely non-uniform electric field on a thin metal wire or the like, pulse discharge in which a short-pulse voltage is applied, and others can be employed. Furthermore, two or more of the foregoing methods can be combined.

Figure 10:
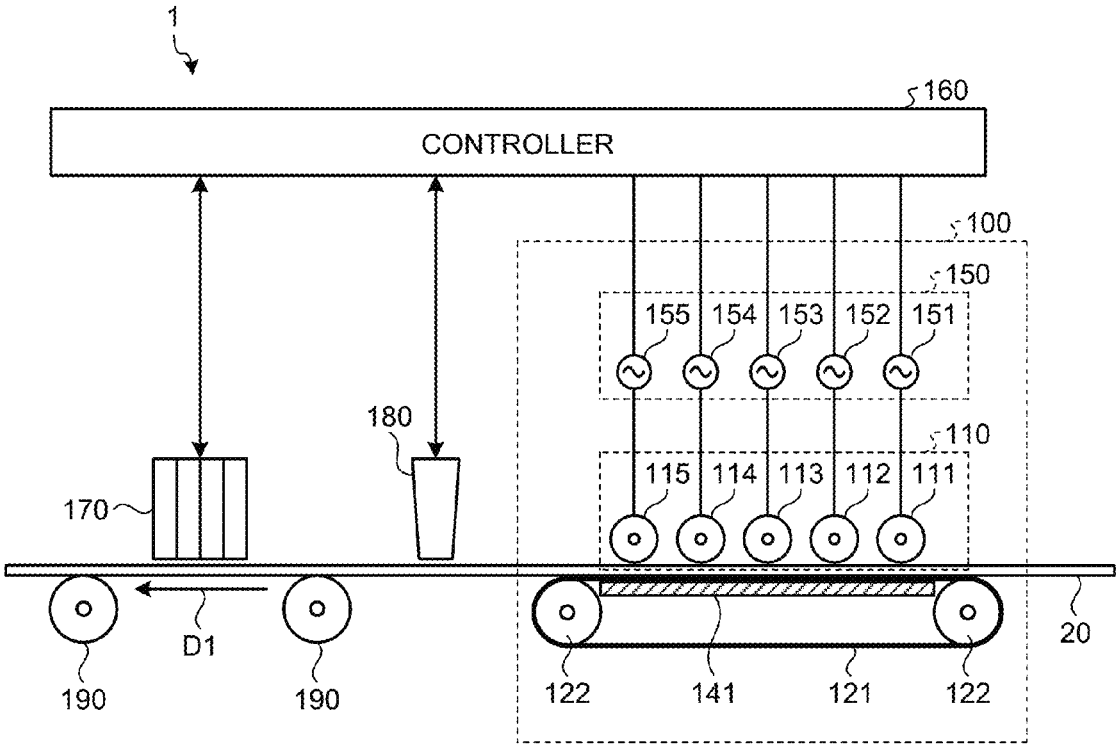
FIG. 10 is a schematic diagram illustrating the configuration of the printing apparatus (system) from the plasma treatment device to an inkjet recording device in the embodiment.

FIG. 10 illustrates the configuration of the printing apparatus (system) 1 illustrated in FIG. 9 by excerpting from the plasma treatment device 100 to the inkjet recording device 170. As illustrated in FIG. 10, the printing apparatus (system) 1 includes the plasma treatment device 100 that performs plasma treatment on the surface of the treatment object 20, the pH detector 180 that measures the pH value of the surface of the treatment object 20, the inkjet recording device 170 that forms an image on the treatment object 20 by inkjet recording, and a controller 160 that controls the whole printing apparatus (system) 1. The printing apparatus (system) 1 further includes conveying rollers 190 to convey the treatment object 20 along the conveying route D1. The conveying rollers 190 convey the treatment object 20 along the conveying route D1 by driving rotatively in accordance with the control by the controller 160, for example.

The plasma treatment device 100 includes, as the same as the atmospheric non-equilibrium plasma treatment device 10 illustrated in FIG. 2, discharge electrodes 110, a counter electrode 141, a high-frequency high-voltage power supply 150, and a dielectric belt 121 that is clamped between the electrodes. In FIG. 10, the discharge electrodes 110 are composed of five discharge electrodes 111 to 115, and the counter electrode 141 is provided in the whole range that faces the discharge electrodes 111 to 115 across the dielectric belt 121. The discharge electrodes 111 to 115 each have a columnar shape or a cylindrical shape, and the columnar surfaces or the cylindrical surfaces thereof that are the respective curved surfaces (lateral surfaces) face the counter electrode 141. The columnar surface or cylindrical surface is a plane formed by lines drawn in parallel to the generatrix from all points of a single circle. Furthermore, the high-frequency high-voltage power supply 150 is composed of five high-frequency high-voltage power supplies 151 to 155 corresponding to the number of the discharge electrodes 111 to 115.

For the dielectric belt 121, to make it serve also to convey the treatment object 20, an endless belt is preferably used. Consequently, the plasma treatment device 100 further includes rotary rollers 122 to convey the treatment object 20 by circulating the dielectric belt 121. The rotary rollers 122 circulate the dielectric belt 121 by driving rotatively based on the instructions given from the controller 160. Consequently, the treatment object 20 is conveyed along the conveying route D1.

The controller 160 can turn the high-frequency high-voltage power supplies 151 to 155 on and off individually. The controller 160 can further adjust the pulse intensity of the high-frequency high-voltage pulses that the high-frequency high-voltage power supplies 151 to 155 supply to the respective discharge electrodes 111 to 115.

The pH detector 180 may be disposed downstream of the plasma treatment device 100 and a pre-coating device (not depicted), and may detect the pH value of the surface of the treatment object 20 on which the pretreatment (acidification treatment) has been performed by any one or both of the plasma treatment device 100 and the pre-coating device and input the pH value to the controller 160. In response to this, the controller 160 may, by performing the feedback control of any one or both of the plasma treatment device 100 and the pre-coating device (not depicted) based on the pH value received from the pH detector 180, adjust the pH value of the surface of the treatment object 20 after the pretreatment.

The amount of plasma energy required for the plasma treatment can be obtained from the voltage value of the high-frequency high-voltage pulse supplied from the high-frequency high-voltage power supplies 151 to 155 to the respective discharge electrodes 111 to 115, the application time thereof, and the current that flowed through the treatment object 20 at that time. Note that the amount of plasma energy required for the plasma treatment may be controlled not for each of the discharge electrodes 111 to 115 but as the amount of energy for the whole discharge electrodes 110.

The treatment object 20 is treated with plasma treatment by running through between the discharge electrodes 110 and the dielectric belt 121 while the plasma is generated in the plasma treatment device 100. Consequently, the chains of binder resin on the surface of the treatment object 20 are broken up and, furthermore, the oxygen radicals and ozone in the gas phase are recombined with macromolecules, whereby polar functional groups are produced on the surface of the treatment object 20. As a result, the surface of the treatment object 20 is given the hydrophilicity and acidification. While the plasma treatment is performed in the atmosphere in the embodiment, it may be performed in a gas atmosphere such as nitrogen and a rare gas.

Furthermore, being provided with a plurality of discharge electrodes 111 to 115 is also effective in that the surface of the treatment object 20 is uniformly acidified. More specifically, supposing that the conveying speed (or printing speed) is the same, the time it takes for the treatment object 20 to run through the plasma space can be made longer when the acidification treatment is performed with a plurality of discharge electrodes than when the acidification treatment is performed with a single discharge electrode. As a result, the acidification treatment can be performed on the surface of the treatment object 20 more uniformly.

The inkjet recording device 170 includes an inkjet head. The inkjet head includes a plurality of heads for the same color (for example, four heads for four colors) to speed-up the printing speed, for example. Furthermore, to achieve high-speed high-resolution (for example, 1200 dpi) image forming, the ink discharge nozzles of the head for each color are fixed being displaced so as to correct the interval. Moreover, the inkjet head can be driven at a plurality of drive frequencies such that the dots of ink (droplets) discharged from each nozzle correspond to three types of volumes referred to as large, medium, and small droplets.

The inkjet head is disposed downstream of the plasma treatment device 100 on the conveying route of the treatment object 20. The inkjet recording device 170, under the control of the controller 160, performs image forming by discharging ink to the treatment object 20 on which the pretreatment (acidification treatment) by the plasma treatment device 100 has been performed.

As illustrated in FIG. 10, the inkjet head of the inkjet recording device 170 may include a plurality of heads for the same color (four heads for four colors). This enables the speed-up of the inkjet recording process. At that time, to achieve the resolution of 1200 dpi at a high-speed, the heads for the respective colors in the inkjet head are fixed being displaced so as to correct the interval between the nozzles that discharge ink. Furthermore, the head for each color receives drive pulses of a drive frequency having a number of variations such that the dots of ink discharged from the nozzles correspond to the three types of volumes referred to as large, medium, and small droplets.

Moreover, being provided with a plurality of discharge electrodes 111 to 115 is also effective in terms of uniformly performing the plasma treatment on the surface of the treatment object 20. That is, supposing that the conveying speed (or printing speed) is the same, the time it takes for the treatment object 20 to run through the plasma space can be made longer when the plasma treatment is performed with a plurality of discharge electrodes than when the plasma treatment is performed with a single discharge electrode. As a result, the plasma treatment can be performed on the surface of the treatment object 20 more uniformly.

Next, the more specific configuration of the discharge electrodes 110 in the plasma treatment device 100 illustrated in FIG. 10 and the high-frequency high-voltage pulse applied to the discharge electrodes 110 will be described in detail with reference to the subsequent drawings.

As explained in the foregoing, in the plasma treatment to lower the pH value of the surface of the treatment object 20 (hereinafter, referred to as a surface pH value), by performing plasma irradiation on the treatment object 20 in the atmosphere, organic ingredients of the surface of the treatment object 20 are decomposed and acidified at a molecular level and acid functional groups (carboxyl groups, and others) are coordinated on the surface.

In detail, when electrons near the discharge electrodes 110 are accelerated in an electric field, the accelerated electrons in high energy increase while exciting gas molecules in the atmosphere, whereby streamer discharge is produced. When the streamer discharge contacts an insulator, it changes to creeping streamer discharge, and as a result, modification treatment is performed extensively on the surface of the treatment object 20. In the creeping streamer discharge, oxygen molecules $O_2$ and water vapor $H_2O$ in the atmosphere are excited, and active species such as atomic oxygen and hydroxyl radicals, and ozone $O_3$ are produced, for example. Because the ozone disassociates the atomic oxygen at the time it returns to oxygen molecules $O_2$, the ozone also becomes a source of active species.

The active species thus produced oxidatively decompose the organic ingredients of the surface of the treatment object 20 and coordinate carboxyl groups COOH as acid functional groups, and thus the surface pH value of the treatment object 20 is lowered. When aqueous ink is made to land on the treatment object 20 for which the surface pH value thereof is lowered, the pigments dispersed by the repulsion of negative charges in an ink droplet are neutralized in electric charge by the hydrogen ions $H^+$ that are disassociated from the carboxyl groups and ionized. As a result, the charge repulsion between pigment particles disappears, and thus the pigments cause dispersion destruction and then flocculate. When the pigments flocculate, the color components of ink cease to flow. Consequently, even when the ink subsequently lands, the pigments are not mixed together and ink dots are formed independently. As a result, the beading and bleeding are restrained.

The surface pH value of the treatment object 20 modified by the plasma treatment in the embodiment as in the foregoing can be checked with the Astro pH Tester Pen S-5 manufactured by Nikken Chemical Laboratory Co., Ltd., for example. The inventers have found that, when the surface pH value of the treatment object 20 is 5 or less, the occurrence of beading and bleeding can be suppressed for given alkaline pigment ink. Furthermore, the inventers have found that, by making the surface pH value 4.5 or less, the occurrence of beading and bleeding can be further suppressed.

The inventers have further found that the diameter of the discharge electrodes 110 (hereinafter, referred to as a discharge electrode diameter) is suitable to be ϕ6 to ϕ10 millimeters. If the discharge electrode diameter is smaller than ϕ6 millimeters, the electrode is easy to warp, and as a result, the discharge is likely to be non-uniform. Meanwhile, if the discharge electrode diameter is larger than ϕ10 millimeters, the power consumption required for discharge increases.

Figure 11:
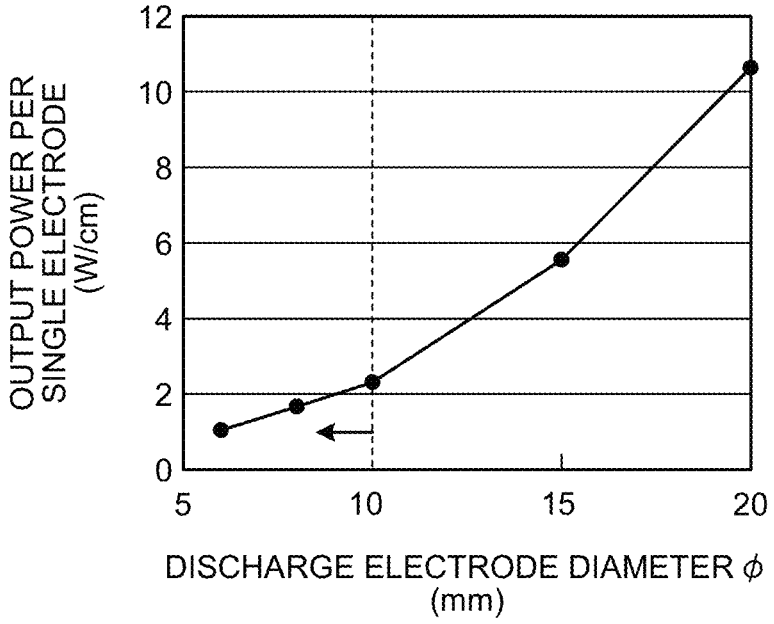
FIG. 11 is a chart illustrating the relation between a discharge electrode diameter and the output power of a single discharge electrode per unit length in the embodiment.

FIG. 11 illustrates the relation between the discharge electrode diameter and the output power of a single discharge electrode per unit length. As illustrated in FIG. 11, when the discharge electrode diameter is larger than ϕ10 millimeters, the output power is increased and the energy efficiency with respect to the pH lowering effect deteriorates. It can be considered that this is because the capacitive reactance is decreased and the current that does not contribute to the discharge is consumed when the discharge electrode diameter is large. From the foregoing, the inventers have found that it is preferable that the discharge electrode diameter be equal to or less than ϕ10 millimeters.

Figure 12:
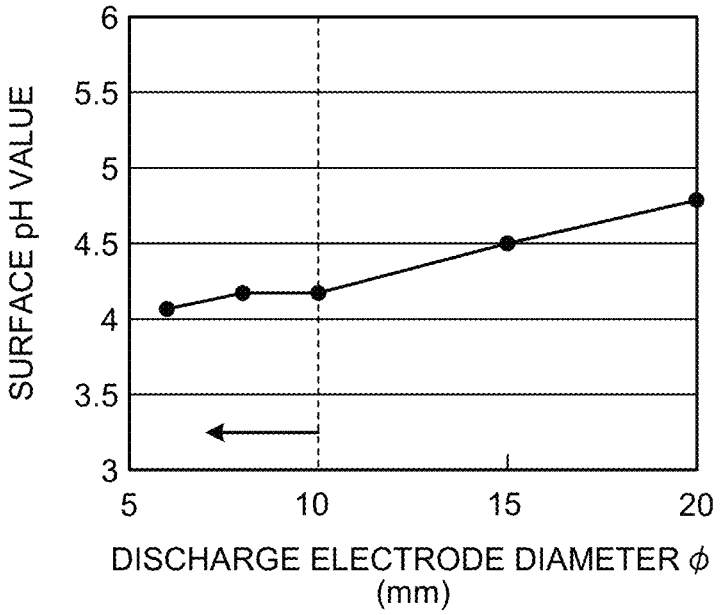
FIG. 12 is a chart illustrating the relation between the discharge electrode diameter and a surface pH value in the embodiment.

Next, the following describes the relation between the diameter of the discharge electrodes 110 (hereinafter, referred to as the discharge electrode diameter) and the surface pH value of the treatment object 20 after the modification treatment when the number of discharge electrode is two or more. Table 1 is a table that represents the relation between the discharge electrode diameter and the surface pH value. FIG. 12 is a chart illustrating the relation between the discharge electrode diameter and the surface pH value obtainable from the result represented in Table 1.

TABLE 1

| | | | | | |
|---|---|---|---|---|---|
| Output Voltage (kVp-p) | 12 | 12 | 12 | 12 | 12 |
| Pulse Frequency (kHz) | 20.2 | 20.2 | 20.2 | 20.2 | 20.2 |
| Discharge Electrode Diameter ϕ (mm) | 6 | 8 | 10 | 15 | 20 |
| Output Power (W/cm · pieces) | 1.05 | 1.67 | 2.31 | 5.56 | 10.58 |
| Discharge-Electrode Adjacent Distance (mm) | 2 | 2 | 2 | 2 | 2 |
| Counter Dielectric Thickness (mm) | 0.7 | 0.7 | 0.7 | 0.7 | 0.7 |
| Coated Paper pH Value | 4.1 | 4.2 | 4.2 | 4.5 | 4.8 |

As illustrated in Table 1 and FIG. 12, in the range in which the discharge electrode diameter is larger than ϕ10 millimeters, the pH lowering effect deteriorates as the discharge electrode diameter increases. From the foregoing, the inventers have found that it is preferable that the discharge electrode diameter be equal to or less than ϕ10 millimeters, and further be equal to or less than ϕ8 millimeters.

Figure 13:
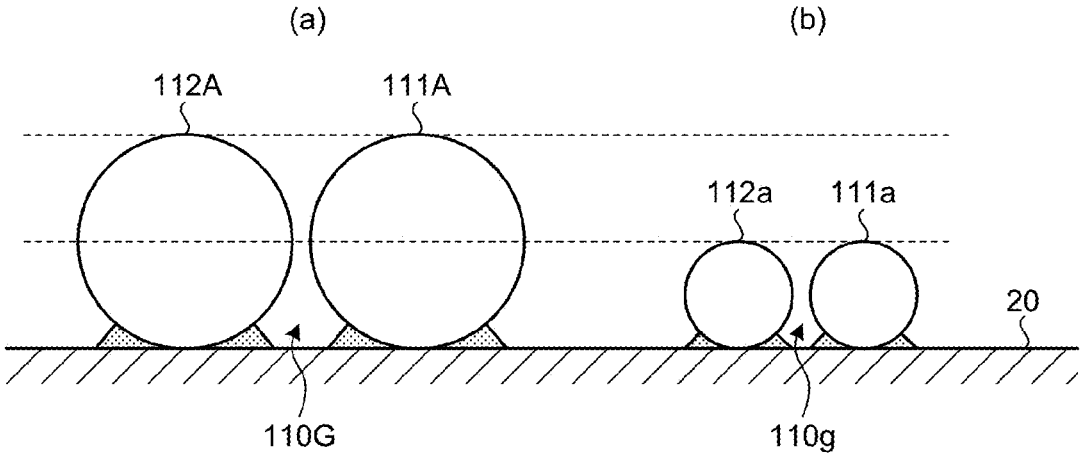
FIG. 13 is a diagram for explaining the size of a free space formed by the difference in the size of discharge electrode diameter in the embodiment.

Now, the following describes the relation between the discharge electrode diameter and the size of space formed below the discharge electrodes (hereinafter, referred to as a free space). FIG. 13 is a diagram for explaining the size of the free space formed by the difference in the size of the discharge electrode diameter. Note that a portion (a) in FIG.

13 illustrates a situation in which the discharge electrode diameter is relatively large and a portion (b) in FIG. 13 illustrates a situation in which the discharge electrode diameter is relatively small. Furthermore, the discharge electrodes 110 each are in a columnar shape in FIG. 13. However, it is not limited to this, and it may be in a cylindrical shape as long as a measure not to deform is taken. Moreover, as long as it is in a shape tapered near the treatment object 20 and in a shape capable of generating streamer discharge, it can be deformed in any way. In FIG. 13, a discharge method of contact type in which the discharge electrodes 110 are made to contact the treatment object 20 is exemplified. However, it is not limited to this, and it may be a discharge method of non-contact type in which the discharge electrodes 110 are not made to contact the treatment object 20.

As is apparent when a free space 110G illustrated in the portion (a) in FIG. 13 and a free space 110*g* illustrated in the portion (b) in FIG. 13 are compared, the free space 110G below discharge electrodes 111A and 112A is increased as the discharge electrode diameter is larger. Thus, when the discharge electrode diameter is large, the active species produced by creeping streamer discharge diffuse broadly so that the contact probability with the surface of the treatment object 20 is lowered. In contrast, as illustrated in the portion (b) in FIG. 13, when the discharge electrode diameter is small, because the free space 110*g* below discharge electrodes 111*a* and 112*a* is small, it is possible to confine the active species in the free space 110*g*. As a result, it can be considered that the contact probability between the treatment object 20 and the active species is enhanced, whereby the modification treatment can be performed on the surface of the treatment object 20 more efficiently.

Figure 14:
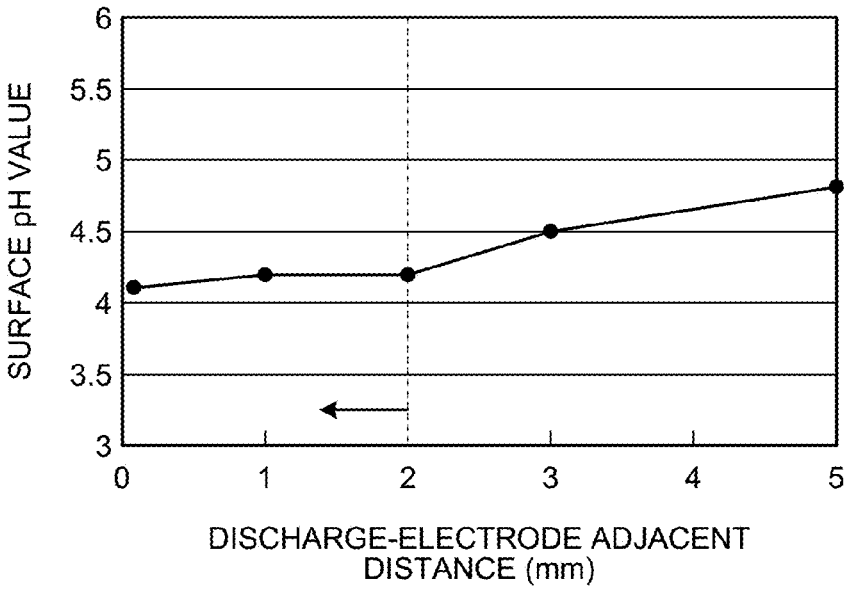
FIG. 14 is a chart illustrating the relation between a discharge-electrode adjacent distance and the surface pH value in the embodiment.

Next, the following describes the relation between the distance between the adjacent discharge electrodes 110 along the conveying route D1 (hereinafter, referred to as a discharge-electrode adjacent distance) and the surface pH value of the treatment object 20. Note that the discharge-electrode adjacent distance (also simply referred to as an adjacent distance) is a shortest distance of a gap formed between the adjacent discharge electrodes 110. Table 2 is a table that represents the relation between the discharge-electrode adjacent distance and the surface pH value. FIG. 14 is a chart illustrating the relation between the discharge-electrode adjacent distance and the surface pH value obtainable from the result represented in Table 2.

TABLE 2

| | | | | | |
|---|---|---|---|---|---|
| Output Voltage (kVp-p) | 12 | 12 | 12 | 12 | 12 |
| Pulse Frequency (kHz) | 20.2 | 20.2 | 20.2 | 20.2 | 20.2 |
| Discharge Electrode Diameter ϕ (mm) | 8 | 8 | 8 | 8 | 8 |
| Discharge-Electrode Adjacent Distance (mm) | 0.1 | 1 | 2 | 3 | 5 |
| Counter Dielectric Thickness (mm) | 0.7 | 0.7 | 0.7 | 0.7 | 0.7 |
| Coated Paper pH Value | 4.1 | 4.2 | 4.2 | 4.5 | 4.8 |

As illustrated in Table 2 and FIG. 14, if the discharge-electrode adjacent distance is greater than 2 millimeters, the pH lowering effect is lowered. It can be considered that this is because the active species leak from an interspace between the discharge electrodes 110, and the contact efficiency with the surface of the treatment object 20 is deteriorated. Consequently, the inventers have found that it is preferable that the discharge-electrode adjacent distance be equal to or less than 2 millimeters.

Figure 15:
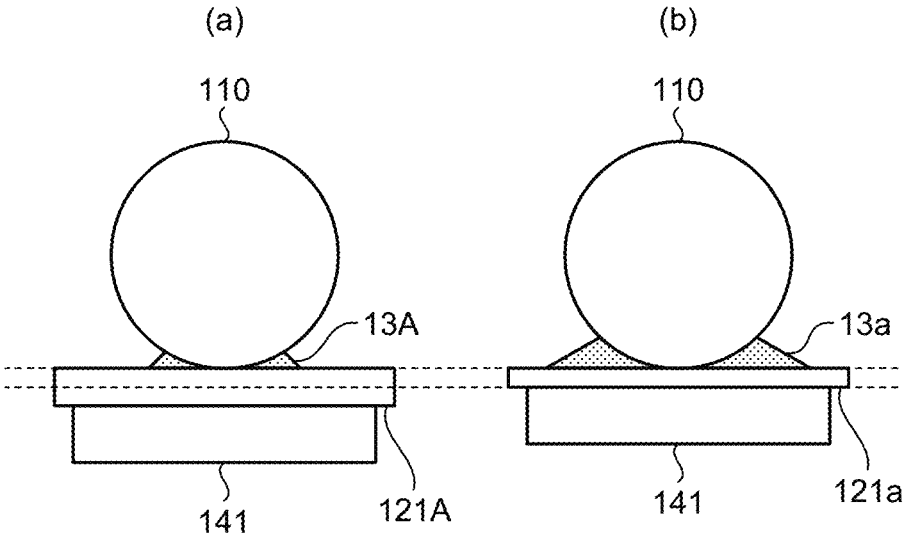
FIG. 15 is a diagram for explaining the relation between a dielectric thickness and a generating state of discharge in the embodiment.

Next, the following describes the relation between the thickness of the dielectric (the dielectric belt 121) interposed between the counter electrode 141 and the discharge electrodes 110 (hereinafter, referred to as a dielectric thickness) and the generating state of discharge. FIG. 15 is a diagram for explaining the relation between the dielectric thickness and the generating state of discharge. Note that a portion (a) in FIG. 15 illustrates a situation in which the dielectric thickness is relatively thick and a portion (b) in FIG. 15 illustrates a situation in which the dielectric thickness is relatively thin.

As illustrated in the portion (a) in FIG. 15, as the thickness of a dielectric 121A is thicker, the distance between the discharge electrodes 110 and the counter electrode (ground electrode) 141 increases and the development length of creeping streamer 13A shortens, and thus the pH lowering effect of the treatment object 20 is lowered. In contrast, as illustrated in the portion (b) in FIG. 15, when the thickness of a dielectric 121*a* is thin, the development length of creeping streamer 13*a* increases and thus the pH lowering effect can be enhanced.

Figure 16:
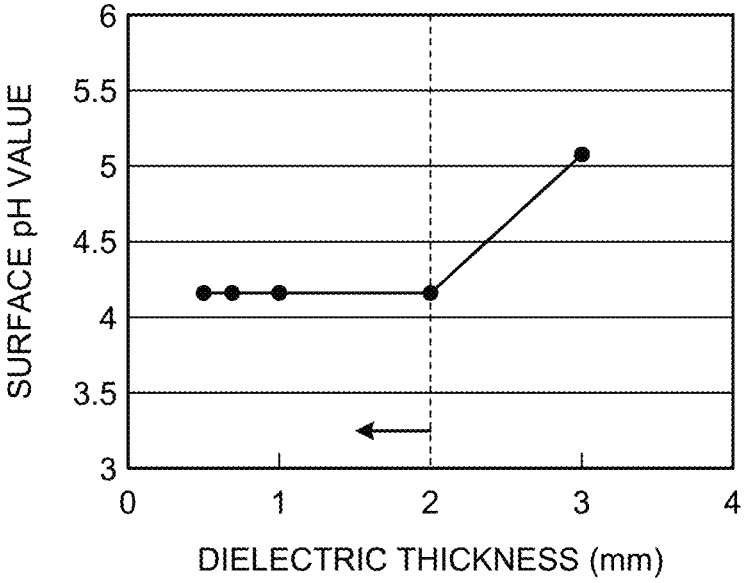
FIG. 16 is a chart illustrating the relation between the dielectric thickness and the surface pH value in the embodiment.

Next, the following describes the relation between the dielectric thickness and the surface pH value of the treatment object 20. Table 3 is a table that represents the relation between the dielectric thickness and the surface pH value. FIG. 16 is a chart illustrating the relation between the dielectric thickness and the surface pH value obtainable from the result represented in Table 3.

TABLE 3

| | | | | | |
|---|---|---|---|---|---|
| Output Voltage (kVp-p) | 12 | 12 | 12 | 12 | 12 |
| Pulse Frequency (kHz) | 20.2 | 20.2 | 20.2 | 20.2 | 20.2 |
| Discharge Electrode Diameter ϕ (mm) | 8 | 8 | 8 | 8 | 8 |
| Discharge-Electrode Adjacent Distance (mm) | 2 | 2 | 2 | 2 | 2 |
| Counter Dielectric Thickness (mm) | 0.5 | 0.7 | 1 | 2 | 3 |
| Coated Paper pH Value | 4.2 | 4.2 | 4.2 | 4.2 | 5.1 |

As illustrated in Table 3 and FIG. 16, if the dielectric thickness becomes greater than 2 millimeters, the pH lowering effect of the surface of the treatment object 20 deteriorates. From the foregoing, the inventers have found that the dielectric thickness is preferably equal to or less than 2 millimeters, and is more preferably equal to or less than 1 millimeter.

According to the embodiments described above, it is possible to provide a treatment-object modifying device, a printing apparatus, a printing system, and a method of manufacturing a print that can manufacture a print of high image quality while reducing an increase in cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A treatment-object modifying device that lowers a pH value of a surface of a treatment object by using dielectric-barrier discharge, the treatment-object modifying device comprising:

a plurality of discharge electrodes disposed over a conveying route of the treatment object;

one or more counter electrodes disposed to face the discharge electrodes across the conveying route so that the one or more counter electrodes is in common with the discharge electrodes or correspond to the respective discharge electrodes; and a dielectric disposed between the discharge electrodes and the one or more counter electrodes, wherein each of the discharge electrodes has a columnar shape or a cylindrical shape, curved surfaces of the discharge electrodes faces the one or more counter electrodes, curved surfaces of the discharge electrodes face one another, a distance between the adjacent discharge electrodes is equal to or less than 2 millimeters; and the dielectric has a thickness along a direction connecting the discharge electrodes and the one or more counter electrodes of equal to or greater than 0.5 millimeter but not greater than 2 millimeters.

2. The treatment-object modifying device according to claim 1, wherein each of the discharge electrodes has a diameter of equal to or greater than 6 millimeters.

3. The treatment-object modifying device according to claim 1, wherein a repetitive pulse voltage is applied to each of the discharge electrodes such that output power per unit length of the discharge electrode is equal to or greater than 1 W/cm but not greater than 2 W/cm.

4. The treatment-object modifying device according to claim 1, wherein a repetitive pulse voltage at a repetitive frequency of 20 kHz or higher is applied to the discharge electrodes.

5. A printing apparatus comprising:

the treatment-object modifying device according to claim 1; and a recording unit that performs inkjet recording on the surface of the treatment object on which modification treatment has been performed by the treatment-object modifying device.

6. A printing system comprising:

the treatment-object modifying device according to claim 1; and a recording device that performs inkjet recording on the surface of the treatment object on which modification treatment has been performed by the treatment-object modifying device.

7. A method of manufacturing a print using a treatment-object modifying device that includes a plurality of discharge electrodes disposed over a conveying route of a treatment object and one or more counter electrodes disposed to face the discharge electrodes across the conveying route so that the one or more counter electrodes is in common with the discharge electrodes or correspond to the respective discharge electrodes, the treatment-object modifying device lowering a pH value of a surface of the treatment object by using dielectric-barrier discharge, and also using a recording device that performs inkjet recording on the surface of the treatment object on which modification treatment has been performed by the treatment-object modifying device, the method comprising:

conveying the treatment object along the conveying route;

applying a discharge voltage between the discharge electrodes and the one or more counter electrodes; and performing inkjet recording on the surface of the treatment object on which the modification treatment has been performed at the applying, wherein each of the discharge electrodes has a columnar shape or a cylindrical shape, curved surfaces of the discharge electrodes faces the one or more counter electrodes, curved surfaces of the discharge electrodes face one another, a distance between the adjacent discharge electrodes is equal to or less than 2millimeters, and a dielectric disposed between the discharge electrodes and the one or more counter electrodes has a thickness along a direction connecting the discharge electrodes and the one or more counter electrodes of equal to or greater than 0.5 millimeter but not greater than 2 millimeters.

8. The treatment-object modifying device according to claim 1, wherein each of the discharge electrodes has a diameter equal to or less than 10 millimeters.

* * * * *